United States Patent [19]

Johnston

[11] Patent Number: 4,541,680

[45] Date of Patent: Sep. 17, 1985

[54] ELECTRICAL CONNECTOR ASSEMBLY

[75] Inventor: James J. Johnston, Old Saybrook, Conn.

[73] Assignee: Brand-Rex Company, Willimantic, Conn.

[21] Appl. No.: 637,144

[22] Filed: Aug. 2, 1984

[51] Int. Cl.[4] ..... H01R 13/39

[52] U.S. Cl. ..... 339/98

[58] Field of Search ..... 339/97 R, 97 P, 98, 339/99 R

[56] References Cited

U.S. PATENT DOCUMENTS 3,579,172 5/1971 Clark ..... 339/97 P 3,771,104 11/1973 Clark ..... 339/98

*Primary Examiner*—Joseph H. McGlynn

*Attorney, Agent, or Firm*—McCormick, Paulding & Huber

[57] ABSTRACT

A telephone/CATV adaptor comprises a generally rectangular panel molded from dielectric plastic material for attachment to an associated wall outlet box to provide a closure for the box. The panel carries a modular telephone jack for receiving a mating modular telephone plug and a bulkhead connector to facilitate connection of a coaxial cable through the panel. A plurality of integral pedestals project from the panel and define body portions of a plurality of electrical connectors. Each connector body portion has a blind bore which includes an inner end portion of square cross section. Insulated terminal end portions of a electrical connectors to be electrically connected to each other are each received within an associated corner of the bore inner end portions. A single threaded fastener, sized to cooperate with the bore, has sharp-edged thread convolutions which cut into the walls of the square bore portion and into insulation on the conductors. The sharp-edged convolutions displace the insulation and incise the conductors to establish electrical contact with the conductors.

16 Claims, 13 Drawing Figures

ELECTRICAL CONNECTOR ASSEMBLY

BACKGROUND OF THE INVENTION

This invention relates in general to electrical connector assemblies and deals more particularly with an improved connector assembly of insulation displacement type for connecting terminal end portions of a plurality of insulated electrical conductors. More specifically, the invention is concerned with an improved electrical connector assembly of a type wherein the insulated terminal end portions to be connected are supported to extend in the same general direction and are electrically connected to each other by a common electrically conductive threaded fastener which is disposed between the terminal end portions, extends in the same general direction as the terminal end portions, and displaces the insulation on the end portions to establish electrical contact with the electrical conductors therein.

A typical connector assembly of the general type with which the present invention is concerned is illustrated and described in U. S. Pat. No. 3,579,172 to Clark for SOLDERLESS CONNECTOR ASSEMBLY, issued May 18, 1971. The connector assembly disclosed in the Clark patent has a main body of dielectric insulation material which includes a central threaded well, receiving a threaded fastener, and a plurality of separate smooth walled conductor receiving bores which merge toward the axis of the central well and intersect the well near its inner end. While a connector assembly disclosed in the Clark patent enables electrical connection of a plurality of sheathed end portions of insulated conductors, without first stripping insulation from or otherwise preparing the conductor end portions, it does have serious shortcomings. The angular arrangement of the merging conductor receiving bores limit the amount contact which can be attained between the fastner and the conductor end portions received within the smooth walled bores. Only a relatively few thread convolutions can be utilized to displace the insulating sheaths on the conductor end portions to establish electrical contact with the conductors contained thereon. Further, the connector assembly shown in the Clark patent is difficult and expensive to manufacture. The merging arrangement of the conductor bores relative to the threaded central bore precludes manufacture using simple bi-parting molds. If a molding technique is employed, expensive special molding tools and/or extensive secondary operations will be required to produce the intersecting bores.

Accordingly; it is the general aim of the present invention is to provide an improved electrical conductor assembly of the aforedescribed general type particularly adopted for low cost manufacture and which provides a high degree of electrical contact integrity.

SUMMARY OF THE INVENTION

In accordance with the present invention, an electrical connector assembly comprises a connector body having an axially extending bore. At least a portion of the bore has a non-circular cross-section. An elongated threaded member coaxially received in the bore has a sharp-edged helical thread sized to cooperate with and incise walls of the bore and cut into and displace electrical insulation on the end portions of a plurality of electrical conductors arranged within the non-circular portion of the bore and extending in the direction of bore extent to establish electrical contact with each of the conductors.

DETAILED DESCRIPTION OF PREFERRED EMBODIMENT

Figure 1:
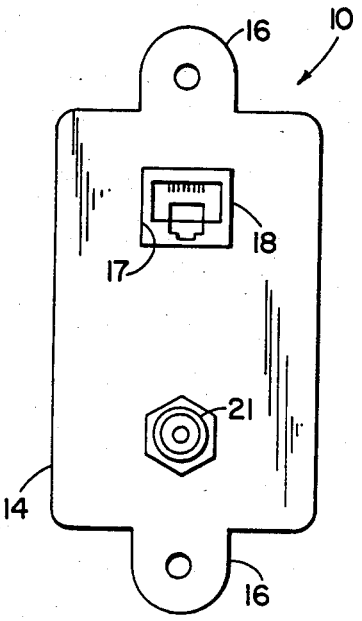
FIG. 1 is a front view of a telephone/CATV adaptor embodying the present invention.
Figure 2:
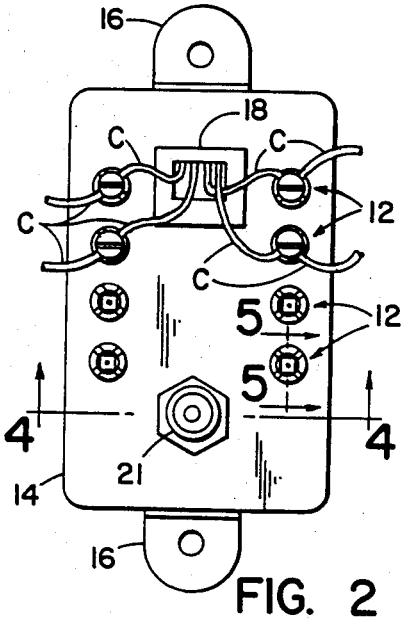
FIG. 2 is a rear view of the adaptor shown in FIG. 1.
Figure 3:
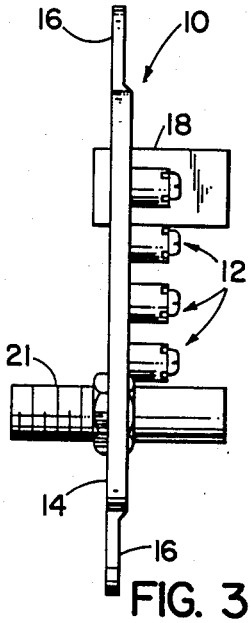
FIG. 3 is a side elevational view of the adaptor.

Turning now to the drawings and referring first particularly to FIGS. 1-4, a telephone/CATV adaptor embodying the present invention and indicated generally by the reference numeral 10 includes a plurality of electrical connector assemblies, indicated generally at 12, 12, for electrically connecting terminal end portions of a plurality of pairs of insulated conductors, as will be hereinafter more fully described.

The illustrated adaptor 10 comprises a panel 14, preferably molded from durable dielectric plastic material, and constructed and arranged for attachment to a wall outlet box (not shown) and connection to the service end of a telephone distribution cable and a video distribution cable to provide telephone and CATV jack assemblies at a common wall location.

Figure 4:
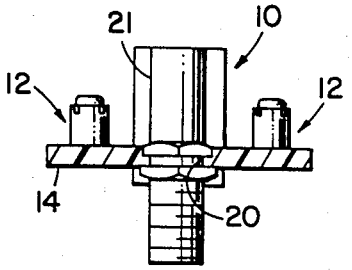
FIG. 4 is a sectional view taken along the line 4—4 of FIG. 2.

The panel 14 is preferably molded from dielectric plastic material, has a generally rectangular form, and includes a pair of integral ears 16, 16, projecting from its upper and lower ends, and apertured to facilitate attachment of the panel to an associated wall outlet box. A rectangular opening 17 through the illustrated panel 14 receives an associated conventional modular phone jack assembly 18, which may be attached to the panel by any suitable means. The rectangular opening 17 is slightly tapered and cooperates with a complimentary taper on the body of the jack 18 to aid in properly positioning the jack relative to the panel 14. The jack 18 may be attached to the panel 14 by any suitable means. In the illustrated embodiment 10 the jack is adhesively bonded to the panel. The panel 14 also has a cylindrical opening 20 through it, as shown in FIG. 4 for receiving a conventional CATV jack or bulkhead connector 21, substantially as shown. A shallow octagonal recess 22 coaxially surrounds the opening 20 and opens through the rear of the panel 14 for receiving an integral nut on the bulkhead connector 21. Another nut threadably connected to the forwardly projecting portion of the bulkhead connector secures it to the panel 14.

The number and arrangement of connector assemblies 12, 12 may vary. Typically, each connector assembly is adapted to terminate wire conductors in a range of sizes. The illustrated adaptor 10 has eight connector assemblies sized to terminate 22–26 AWG telephone wires and may, for example, be used to terminate four-pair telephone wire. However, additional connector assemblies may be provided, if desired, to accommodate additional phone service and a wide range of communications, control, monitoring or audio applications.

Considering now a typical electrical connector assembly 12 and referring further to FIGS. 5–10, the assembly includes a connector body 24 defined by an integral cylindrical pedestal which projects in a rearward direction from the rear surface of the panel 14, and a single threaded member or connector screw 26. The connector body 24 has a blind bore which opens coaxially outwardly through its rear surface. The inner end portion of the bore, designated by the numeral 28, has a non-circular cross-section, which is preferably substantially square. The outer end portion of the bore, indicated by the numeral 30, is preferably generally cylindrical and somewhat diametrically enlarged relative to the inner portion 28.

Figure 8:
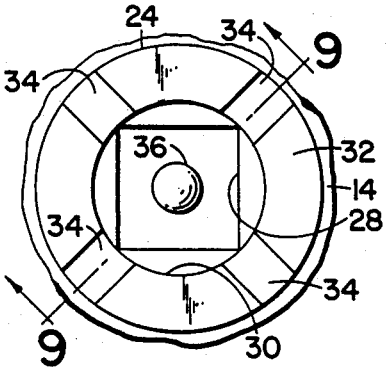
FIG. 8 is a rear view of the connector body shown in FIG. 7.
Figure 9:
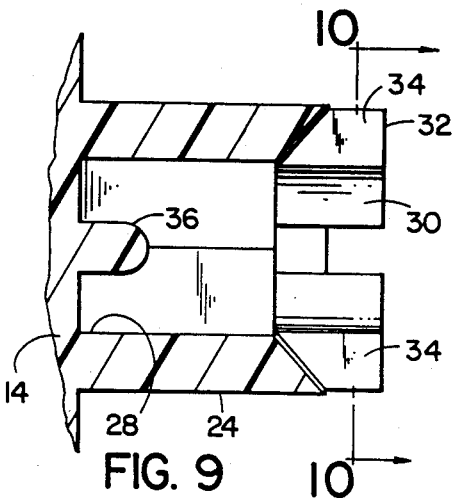
FIG. 9 is a fragmentary sectional view taken along the line 9—9 of FIG. 8.
Figure 10:
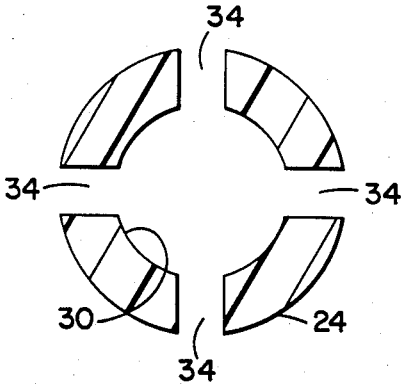
FIG. 10 is a sectional view taken along the line 10—10 of FIG. 9.

The rear surface of the connector body 24 defines a generally radially disposed annular bearing surface 32 which coaxially surrounds the bore outer end portion 30. A plurality of openings or radially extending slots 34,34 communicate with the bore outer end portion 30. The slots open radially outwardly and through the bearing surface 32, as best shown in FIGS. 8–10. The number and arrangement of the slots 34, 34, is determined by the shape of the non-circular bore portion and the number of connector end portions which the connector assembly is to accomodate. However, the illustrated connector body 24 has four slots. Each 34 slot is preferably arranged in general registry with an associated corner of the square bore portion 28, as best shown in FIG. 8. Each slot has an inner end wall which is inclined rearwardly and outwardly in a generally radial direction from the bore 28. The width and depth dimensions of the slots are preferably slightly greater than the outside diameter of the insulated conductors to be connected. A post 36 projects coaxially outwardly from the inner end wall of the bore, as shown in FIGS. 5 and 9 for a purpose which will be hereinafter further evident.

The connector screw 26 preferably comprises a sheet metal screw which has sharp thread convolutions of substantially uniform diameter throughout a substantial portion of its length. A diametrically enlarged head on one end of the screw 26 defines a generally radially disposed annular seating surface 38 for seating engagement with the bearing surface 32. The screw 26 is sized to cooperate with the connector body within the bore portion 28 to anchor a plurality of insulated conductors in the bore and establish electrical contact with each of the conductors.

Figure 5:
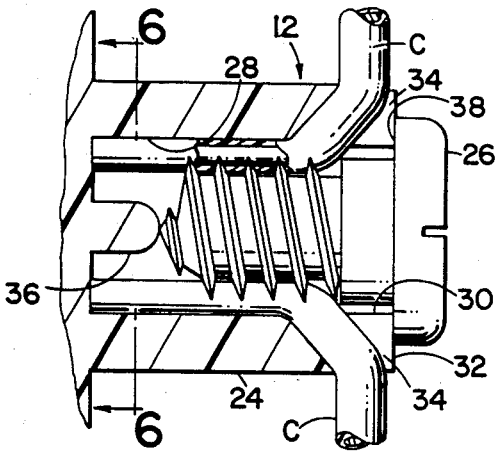
FIG. 5 is a somewhat enlarged fragmentary sectional view taken along the line 5—5 of FIG. 2 and shows a typical connector assembly in electrically connected relation to the insulated end portions of a pair of insulated conductors.
Figure 6:
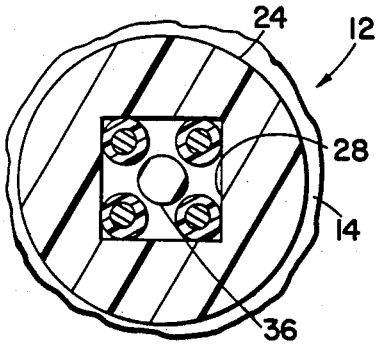
FIG. 6 is a fragmentary sectional view taken along the line 6—6 of FIG. 5.
Figure 7:
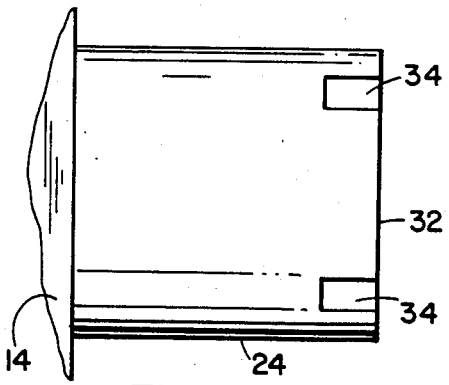
FIG. 7 is a somewhat enlarged fragmentary side elevational view of a connector body.

The terminal end portion of each conductor to be connected is inserted into the bore and seated within an associated corner of the non-cylindrical portion 28, as best shown in Figs. 5 and 6, where the conductors are indicated by the letters C,C. The post 36 maintains the free end portion of each conductor generally within an associated corner to the bore portion 28. A projecting portion of each insulated conductor C is positioned within an associated one of the slots 34,34. The self-tapping screw 26 is next inserted into the bore at an entry position between the various insulated conductors C,C. The screw is then threaded into assembly with the connector body 24. As the threaded screw 26 advances, the insulated terminal end portions of the conductors C,C are forced tightly into the corners of the square portion of the bore, and the sharp-edged thread convolutions engage and cut into the walls of the bore. The thread convolutions also cut into and spread or displace insulation on each conductor C. The sharp crests of the thread incise each conductor C to establish electrical contact with it. Since the thread is of substantially uniform diameter throughout a substantial portion of its length, several thread convolutions engage and cut into each electrical conductor C to establish electrical contact with it whereby the various electrical conductors C,C are connected to each other by and through the connector screw 26. The seating surface 38 engages and seats upon the bearing surface 32 when the assembly is completed to prevent damage to the post 36.

Figure 11:
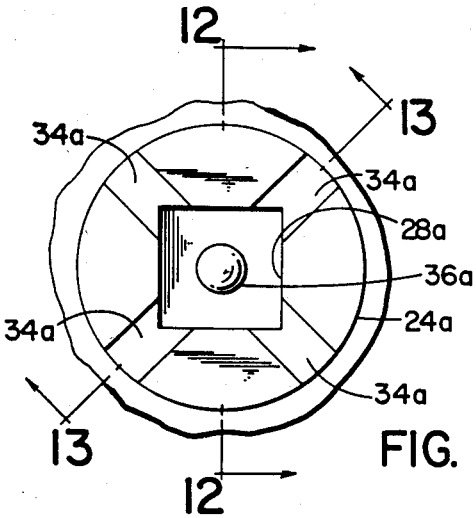
FIG. 11 is a somewhat enlarged fragmentary rear view of the body of another connector assembly embodying the present invention.
Figure 12:
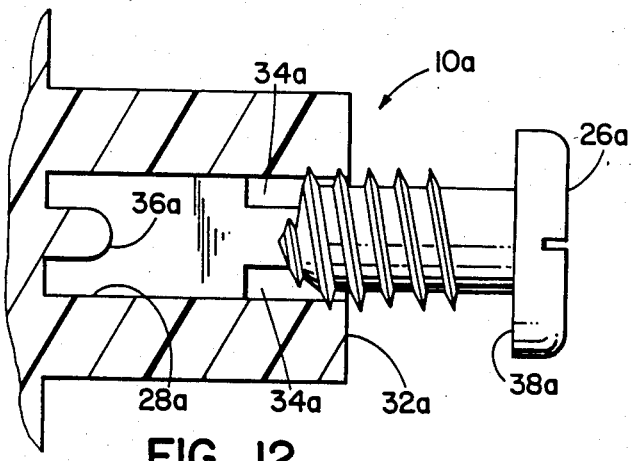
FIG. 12 is a fragmentary sectional view taken along the line 12—12 of FIG. 11 but shows the connector body with a connector screw engaged therein.
Figure 13:
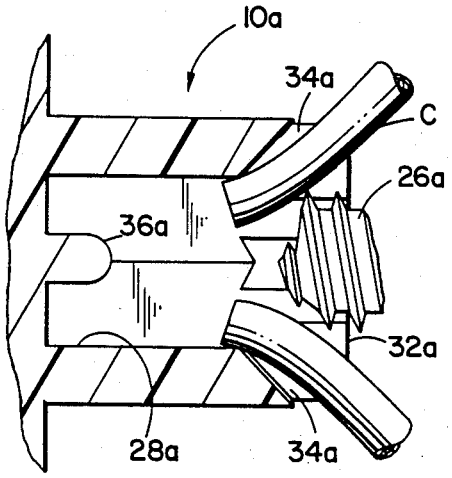
FIG. 13 is a view similar to FIG. 12 but taken along the line 13—13 of FIG. 11.

In connecting insulated conductors using a connector assembly such as the assembly 10, hereinbefore described, the conductors must be inserted into the connector body 24 before the connector screw 26 is threaded into the body. However, for some purposes, it may be desirable to provide a connector assembly which includes a connector screw partially assembled with a connector body and wherein insulated conductors to be connected may be inserted into the connector body without first removing the connector screw. Such a connector assembly is illustrated by FIGS. 11–13 and indicated generally at **10*a*. Parts of the assembly 10*a*, substantially identical to parts of the assembly 10**, previously described, bear the same reference numerals as the previously described parts and a letter a suffix and will not be hereinafter further described in detail.

Refering now to FIGS. 11–13 the conductor assembly **10*a* is similar in many respects to the conductor assembly 10, but differs from it in that the conductor body 24*a* includes a blind bore 28*a* which has a substantially uniform non-circular cross section throughout its entire length. The conductor assembly 10*a* further differs from the conductor assembly 10 in that the openings or slots 34*a*, *34a* are of substantially greater axial depth than the corresponding slots 34,34** of the previously described embodiment.

In FIGS. 12 and 13 the conductor screw **26*a* is shown engaged within the outer end portion of the bore 28*a*. Each slot 34*a* is of sufficient depth to allow insertion of an associated conductor, such as the conductor C shown in FIG. 13, through the slot 34*a* into the bore 28*a* without requiring removable of the screw 26*a*. Thus, the connector assembly 10*a* may be marketed in an at least a partially assembled condition and may be used to connect insulated conductors of appropriate size without removing the connector screw 26*a* from the connector body 24*a***.

The embodiments chosen to illustrate the invention show connector screws of relatively short length. However, it should be understood that connector assemblies of various axial lengths may be used in practicing the invention. If a greater degree of electrical contact is desired, it is only necessary to provide a conductor assembly having a relatively long body and a connector screw sized accordingly for use with the longer body, and such arrangements are contemplated within the scope of the present invention.

I claim:

1. A connector assembly comprising a connector body having an axially extending bore, at least a portion of said bore having a non-circular cross-section, and means for electrically connecting end portions of a plurality of insulated electrical conductors disposed within said bore portion and extending in the general direction of bore extent and including a single threaded member having a sharp-edged helical thread and sized to cooperate with said bore portion and cut into and displace insulation on the terminal ends of a plurality of individual electrical conductors disposed within said bore portion to establish a plurality of electrical contacts with each of the conductors and anchor the insulated conductors within said bore.

2. An electrical connector assembly as set forth in claim 1 wherein said connector body has a plurality of conductor receiving openings therethrough communicating with said bore.

3. An electrical connector assembly as set forth in claim 1 wherein said outer end defines an annular bearing surface surrounding said bore and said openings comprise radially disposed slots opening outwardly through said bearing surface.

4. An electrical connector assembly as set forth in claim 3 wherein said non-circular cross section is defined by an inner portion of said bore and said bore includes a diametrically enlarged outer end portion.

5. An electrical connector assembly as set forth in claim 3 wherein each one of said slots has a depth sufficient to allow insertion of an associated insulated terminal end portion through said one slot and into said bore while said threaded member is engaged with said connector body.

6. An electrical connector assembly as set forth in claim 5 wherein said bore has a substantially uniform non-circular cross-section throughout its entire axial length.

7. An electrical connector assembly as set forth in claim 1 wherein said connector body includes means for maintaining the terminal ends of the conductors in spaced apart relation to each other when the terminal end portions are disposed within said bore portion.

8. An electrical connector assembly as set forth in claim 7 wherein said means for maintaining the terminal end portions comprises a coaxially extending post disposed within the inner end of said bore in spaced relation to the surface of said bore.

9. An electrical connector assembly as set forth in claim 1 wherein said non-circular bore portion has a substantially uniform cross-section throughout its axial length.

10. An electrical connector assembly as set forth in claim 9 wherein said threaded member has a plurality of helical thread convolutions of uniform diameter along a substanital portion of its length.

11. An electrical connector assembly as set forth in claim 10 wherein said threaded member comprises a self-tapping screw.

12. A telephone adaptor comprising a generally rectangular panel sized to form a closure for an electrical outlet box, a modular telephone jack carried by said panel for receiving a mating modular telephone plug, and connecting means on said panel for electrically connecting end portions of a plurality of pairs of insulated electrical conductors and including a plurality of connector assemblies, each of said connector assemblies having a conductor body connected at its inner end to said panel and projecting outwardly from said panel, said connector body having an axially extending bore opening axially outwardly through its outer end, at least a portion of said bore having a non-circular cross-section and a single threaded member having a sharp-edged helical thread and sized to cooperate with said bore to cut into and displace the insulation on the end portions a plurality of individual electrical conductors arranged within said bore inner end portion in generally parallel relation to the bore axis to establish a plurality of electrical contact with each of the conductors and anchor the insulated conductors within the bore when said fastener is driven into said bore between the insulated conductors positioned therein.

13. A telephone adaptor as set forth in claim 12 wherein said outer end portion defines a generally radially disposed annular bearing surface surrounding said bore, each of said connector bodies has a plurality of radially disposed slots communicating with said bore and extending radially therethrough, said slots opening outwardy through said annular bearing surface, each of said slots being sized to receive a portion of an associated one of the insulated conductors, and said fastener has an enlarged head defining a generally radially disposed seating surface for seating engagement with said bearing surface when said fastener is assembled with said connector body.

14. A telephone adaptor as set forth in claim 13 wherein said bore has a substanially uniform non-circular cross-section throughout its entire axial length.

15. A telephone adaptor as set forth in claim 14 wherein each one of said slots is sized to allow insertion of an associated insulated terminal end portion therethrough and into said bore when a threaded fastener is engaged with said body within an outer end portion of said bore.

16. A telephone adaptor comprising a generally rectangular panel, means for securing said plate to an associated electrical outlet box to provide a closure for said box, a modular telephone jack carried by said panel and defining a forwardly opening receptacle for receiving a modular telephone plug, and connecting means on said panel for electrically connecting end portions of a plurality of pairs of insulated electrical conductors and including a plurality of connector assemblies, each of said connector assemblies having a connector body integrally connected at its inner end to the rear surface of said panel and projecting outwardly from said rear surface, said connector body having a blind bore opening axially outwardly through its outer end, said bore having an inner end wall and an inner end portion of square cross-section, said bore having a diametrically enlarged outer end portion opening outwardly through said body outer end, said body outer end defining a generally radially disposed bearing surface surrounding said bore, said connector body having four equiangularly spaced and radially disposed slots extending therethrough and communicating with said bore outer end portion, said slots being in registry with the corners of said square inner end portion and opening outwardly through said bearing surface, a post disposed within bore inner end portion and projecting coaxially outwardly from said inner end wall in spaced relation to the walls of said inner end portion, and a single threaded fastener having sharp edged helical thread convolutions and sized to incise the walls of said bore inner end portion and cut through the insulation terminal end portions of a plurality of individual electrical conductors each arranged in an associated corner of said bore inner end portion and extending in a direction parallel to the axis of said bore, said fastener having a diametrically enlarged head defining a generally radially disposed seating surface for seating engagement with said bearing surface when said fastener is driven into said bore.

* * * * *